US011230893B2

(12) United States Patent
Pettersen et al.

(10) Patent No.: US 11,230,893 B2
(45) **Date of Patent: *Jan. 25, 2022**

(54) METHOD OF MANUFACTURING A SIDE POCKET MANDREL BODY

(71) Applicant: PETROLEUM TECHNOLOGY COMPANY AS, Stavanger (NO)

(72) Inventors: Ståle Pettersen, Sandnes (NO); Kristian Harestad, Randaberg (NO)

(73) Assignee: Petroleum Technology Company AS, Stavanger (NO)

( * ) Notice: Subject to any disclaimer, the term of this patent is extended or adjusted under 35 U.S.C. 154(b) by 0 days.

This patent is subject to a terminal disclaimer.

(21) Appl. No.: 16/881,759

(22) Filed: May 22, 2020

(65) Prior Publication Data

US 2020/0284103 A1 Sep. 10, 2020

Related U.S. Application Data

(63) Continuation of application No. 15/513,039, filed as application No. PCT/EP2015/075109 on Oct. 29, 2015, now Pat. No. 10,662,723.

(30) Foreign Application Priority Data

Nov. 3, 2014 (NO) ..... 20141300

(51) Int. Cl.
*E21B 17/18* (2006.01)
*E21B 43/12* (2006.01)
*E21B 17/042* (2006.01)

(52) U.S. Cl.
CPC ..... *E21B 17/18* (2013.01); *E21B 17/042* (2013.01); *E21B 43/122* (2013.01); *E21B 43/123* (2013.01)

(58) Field of Classification Search
CPC ..... E21B 17/18; E21B 17/042; E21B 43/122; E21B 43/123; E21B 23/03
See application file for complete search history.

(56) References Cited

U.S. PATENT DOCUMENTS 2,970,648 A 2/1961 Daffin et al.
4,333,527 A 6/1982 Higgins et al.
(Continued)

FOREIGN PATENT DOCUMENTS

EP 2536917 12/2013
WO 2007/091898 8/2007

*Primary Examiner* — Christopher J Besler
*Assistant Examiner* — Christine Bersabal
(74) *Attorney, Agent, or Firm* — K&L Gates LLP

(57) ABSTRACT

A method of producing a side pocket mandrel body (1) for use in a hydrocarbon well side pocket mandrel assembly, which mandrel body comprises: a first end (2) displaying a first connection arrangement (3) for connecting the mandrel body to an up-hole section of a production tubing of the hydrocarbon well, and a second end (4) displaying a second connection arrangement (5) for connecting the mandrel body to a down-hole section of the production tubing; a longitudinal, through-going main conduit (6) for communicating with a central passageway of the production tubing; and a side pocket section (7) comprising at least one side pocket (8) for retrievably housing an injection fluid flow control device. The method comprises the steps of: providing a continuous, solid piece of material with the through-going main conduit; in the solid piece of material, forming said at least one side pocket by machining a bore (21), displaying an external entrance opening (23), into a laterally offset section of the solid piece of material generally parallel to the main conduit such that an internal wall section (9) of the solid piece of material is brought to separate the main conduit from the machined bore; plugging the entrance opening (23) of the machined bore with a fluid-tight plug (Continued)

Figure 1:
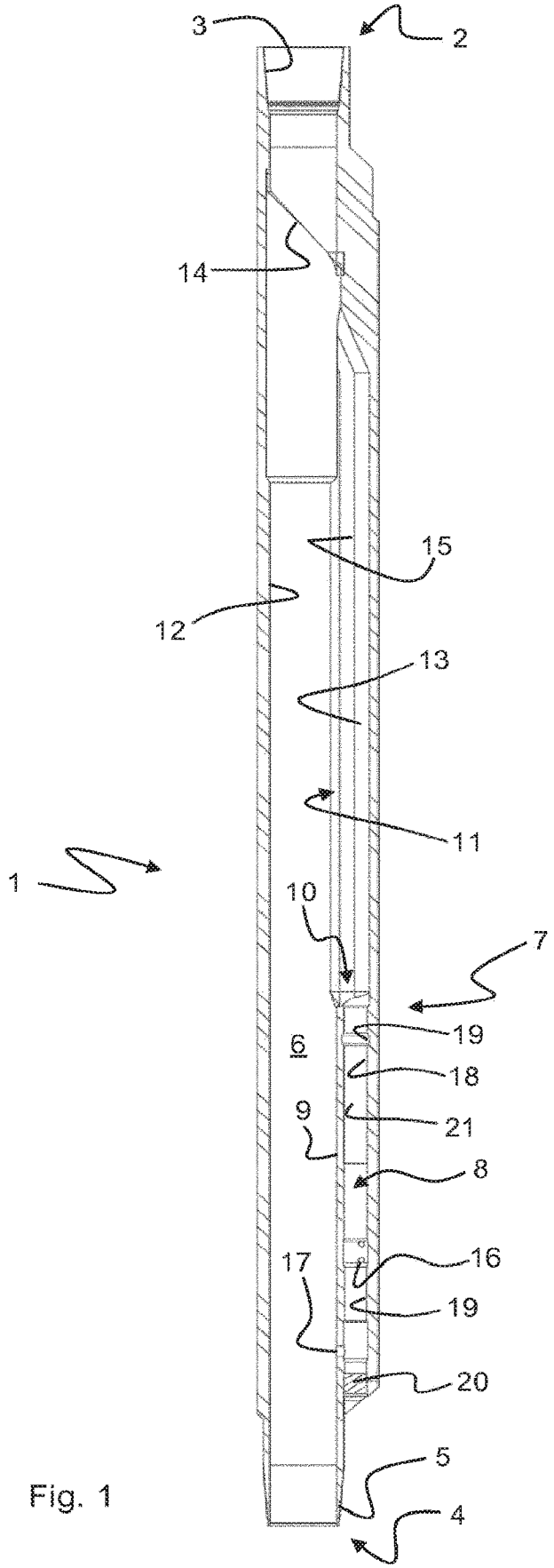

(20); providing at least one opening (16) from an outside of the mandrel body into the at least one side pocket, thereby forming an injection fluid inlet; providing at least one opening in the wall section, thereby forming an injection fluid outlet; and providing the solid piece of material with the first and the second connection arrangements, thereby rendering the mandrel body connectable to the up-hole and down-hole sections of the production tubing.

11 Claims, 2 Drawing Sheets

(56) References Cited

U.S. PATENT DOCUMENTS

| | | | |
|---|---|---|---|
| 4,603,736 | A | 8/1986 | Moore |
| 4,757,859 | A | 7/1988 | Schnatzmeyer |
| 2004/0035575 | A1 | 2/2004 | Roth et al. |
| 2009/0250227 | A1 | 10/2009 | Brown et al. |

METHOD OF MANUFACTURING A SIDE POCKET MANDREL BODY

The present application relates to a method of producing a side pocket mandrel body for use in a side pocket mandrel assembly of a hydrocarbon well, which side pocket mandrel body comprises:

- a first end displaying a first connection arrangement for connecting the side pocket mandrel body to an up-hole section of a production tubing of the hydrocarbon well, and a second end displaying a second connection arrangement for connecting the side pocket mandrel body to a down-hole section of the production tubing,
- a longitudinal, through-going main conduit for communicating with a central passageway of the production tubing, and
- a side pocket section comprising at least one side pocket for retrievably housing an injection fluid flow control device.

A hydrocarbon well generally comprises a production tubing which extends down hole into a wellbore of the well for the purpose of communicating well fluid from one or more subterranean formations through a central passageway of the production tubing to the well's surface.

Hydrocarbon wells are frequently equipped with side pocket mandrel assemblies comprising a side pocket mandrel body and one or a plurality of injection fluid flow control devices, e.g. valve members, e.g. gas lift or injection valves, which are mounted in the side pocket mandrel body in order to allow fluid, e.g. injection fluid, to flow from an annulus outside of the mandrel body and into the central passageway, e.g. to stimulate the production flow rate of the hydrocarbon well.

One type of injection valve which may be mounted in a side pocket is disclosed in WO2007/091898A1, which is herein incorporated by reference in its entirety.

Typically, the injection fluid flow control devices are retrievably mounted in the mandrel body such that they can be retrieved and replaced via the central passageway of the production tubing, e.g. by means of slickline or wireline operations.

A side pocket mandrel body is typically elongated and comprises a first end displaying a first connection arrangement for connecting the mandrel body to an up-hole section of the production tubing, and a second end displaying a second connection arrangement for connecting the mandrel body to a down-hole section of the production tubing. The first and second connection arrangements may typically comprise inner or outer threads for forming threaded connections with the up-hole and down-hole production tubing sections.

The mandrel body comprises a main or central, longitudinally extending through-going channel or conduit, which is arranged to communicate with the central passageway of the production tubing when the mandrel body is connected to the up-hole and down-hole production tubing sections. The main conduit typically has a diameter which generally corresponds to the diameter of the central passageway, and when the mandrel body is mounted in the hydrocarbon well, the main conduit is typically aligned with the central passageway of the up-hole and down-hole production tubing sections.

The mandrel body also comprises a side pocket section comprising at least one side pocket providing receptacles for the above-discussed injection fluid flow control device or devices. The side pocket or pockets, which are typically elongated, are generally arranged laterally offset the main conduit, i.e. generally parallel to the main conduit.

The mandrel body further comprises at least one first opening or passage providing a fluid conduit from the outside of the mandrel body to the side pocket section, and at least one second opening or passage providing a fluid conduit from the side pocket section to the main conduit of the mandrel body, which first and second passages provide a passageway for an injection fluid from the outside of the mandrel body to the main conduit via the side pocket section, thus allowing the injection fluid flow control device or devices of the side pocket section to regulate the flow of injection fluid from the outside of the mandrel body and into the main conduit. Typically, the flow control device or devices are capable of preventing fluid flow in the other direction, i.e. from the main conduit and to the outside of the mandrel body.

If the side pocket section comprises a plurality of side pockets, the mandrel body may comprise additional passages providing fluid conduits between the side pockets allowing the injection fluid flow control devices in the side pockets to be connected in series. For example, if the side pocket section comprises a first side pocket for receiving a first flow control device and a second side pocket for receiving a second flow control device, which first and second fluid control devices are arranged to be operate in series, e.g. one after the other in the flow direction of the injection fluid, it may be advantageous to arrange said at least one first opening such that it provides a fluid conduit from the outside of the mandrel body to an inlet port of the first side pocket, to arrange said at least one second opening such that it provides a fluid conduit from an outlet port of the second side pocket to the main conduit, and to arrange at least one third opening or passage such that it provides a fluid conduit from an outlet port of the first side pocket to an inlet port of the second side pocket, e.g. as is disclosed in EP2536917B1, which is herein incorporated by reference in its entirety.

Due to the complex internal geometry of a side pocket mandrel body, the mandrel body is produced by welding a plurality of body sections together to form the completed mandrel body. This allows easy machining of the internal structures of the mandrel body since these internal structures, prior to the joining of the body sections, can be easily accessed. However, joining body section in this manner requires extensive quality checks of the welded seams at the time of production and also throughout the operable lifetime of the mandrel body. Such quality checks may comprise non-destructive testing (NDT), e.g. computed tomography (CT) scanning using x-rays. However, such testing is time consuming and expensive. This is in particularly true for down-hole equipment, such as a down-hole mounted side pocket mandrel body.

Consequently, there is a need for a method of producing a side pocket mandrel body which at least partly reduces the need for non-destructive testing. The present invention relates to such a method.

The method according to the present invention comprises that steps of:

- providing a continuous, solid piece of material with the through-going main conduit,
- in the solid piece of material, forming said at least one side pocket by machining a bore into the solid piece of material such that an internal wall section of the solid piece of material is brought to separate the main conduit from the machined bore, plugging an entrance opening of the machined bore with a fluid-tight plug, providing at least one opening from an outside of the mandrel body into the at least one side pocket, thereby forming an injection fluid inlet, providing at least one opening in the wall section, thereby forming an injection fluid outlet, and providing the solid piece of material with the first and the second connection arrangements, thereby rendering the side pocket mandrel body connectable to the up-hole and down-hole sections of the production tubing.

The step of forming the at least one side pocket by machining a bore and subsequently plugging the entrance opening of the bore makes it possible to produce the mandrel body from a continuous, solid piece of material. This, in turn, makes it possible to produce the mandrel body without resorting to welding mandrel sub-parts together, which makes away with the extensive quality checks of the welded seams.

The step of forming said at least one side pocket may advantageously comprise the sub-step of machining structures for interacting with latches and seals of the injection fluid flow control device in an internal surface of the machined bore. Alternatively, the step of forming said at least one side pocket may advantageously comprise the sub-step of inserting a hollow cylinder into the machined bore prior to the step of plugging the entrance opening, which cylinder, on the inside surface thereof, comprises structures for interacting with latches and seals of the injection fluid flow control device.

The step of plugging the entrance opening of the machined bore with a fluid-tight plug may advantageously comprise the sub-steps of providing the plug with external threads, providing the entrance opening with internal threads, and screwing the plug into the entrance opening.

During the step of forming said at least one side pocket by machining a bore into the solid piece of material such that an internal wall section of the solid piece of material is brought to separate the main conduit from the machined bore, it may be advantageous to machine the bore through the solid piece of material such that the bore, after machining, displays an entrance opening and an exit opening. In such a case, the method according the invention need to comprise the step of plugging the exit opening as well as the entrance opening.

In the following, an embodiment of the present invention will be disclosed in more detail with reference to the appended drawings, wherein like reference numerals refer to like parts throughout the views.

FIG. 1 is a cross-sectional view of a side pocket mandrel body produced using a method according to the present invention.

Figure 2:
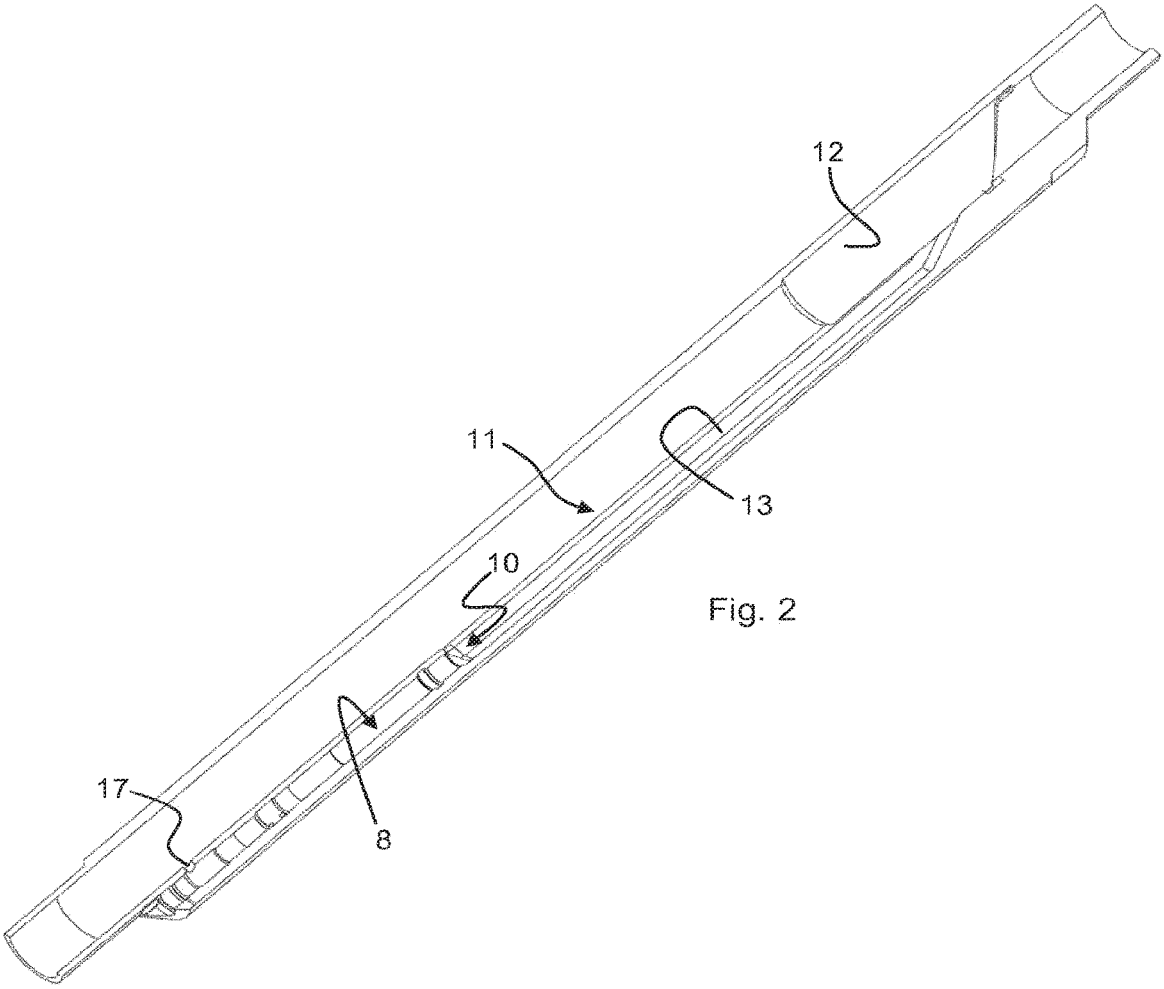

FIG. 2 discloses the mandrel body according to FIG. 1 in a cut-open, perspective view.

Figure 3:
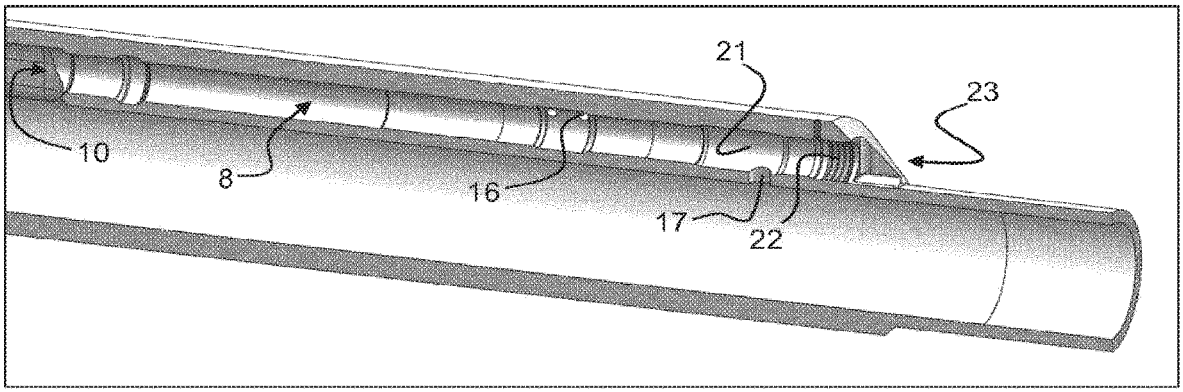

FIG. 3 discloses the mandrel body according to FIG. 1 in a cut-open, perspective partial view.

FIG. 1 discloses an embodiment of a side pocket mandrel body 1 according to the invention. The mandrel body 1, which is elongated, comprises a first end 2 displaying a first connection arrangement 3 for connecting the mandrel body 1 to an up-hole section (not disclosed) of a hydrocarbon well production tubing, and a second end 4 displaying a second connection arrangement 5 for connecting the mandrel body 1 to a down-hole section (not disclosed) of the production tubing. The first and second connection arrangements 3, 5 comprise inner and outer threads for forming threaded connections with the up-hole and down-hole production tubing sections, respectively.

The mandrel body 1 comprises a main or central, longitudinally extending through-going channel or conduit 6, which is arranged to communicate with a central passageway of the production tubing when the mandrel body 1 is connected to the up-hole and down-hole production tubing sections. The main conduit 6 typically has a diameter which corresponds to the diameter of the central passageway of the production tubing, and when the mandrel body 1 is mounted in the hydrocarbon well, the main conduit is typically aligned with the central passageway of the up-hole and down-hole production tubing sections.

The mandrel body 1 also comprises a side pocket section 7 which comprises at least one elongated, laterally offset side pocket 8 for receiving and harboring an injection fluid flow control device, e.g. a gas lift valve, e.g. a gas lift valve of the type disclosed in the above-mentioned document WO2007/091898A1. The side pocket 8, which displays generally circular-symmetric cross-sections, is laterally offset the main conduit 6 and extends generally parallel to the same such that the side pocket 8 and the main conduit 6 is separated by an internal wall section 9 in the mandrel body 1. The side pocket 8 discloses an opening 10 which is in communication with the main conduit 6 via an elongated recess 11 in the side pocket section 7, which recess 11 extends in the axial direction of the mandrel body 1 adjacent to the main conduit 6. In other words, the recess 11 is open towards the main conduit 6 such that the side pocket 8 can be accessed from the main conduit 6 via the recess 11.

In a manner which is known as such, the injection fluid flow control device can be retrieved and replaced via the recess 11 and the opening 10 by running a tool (not depicted) down the central passage-way of the production tubing and into the main conduit 6. To this end, an internal surface 12 of the main conduit 6 and an internal surface 13 of recess 10 exhibit internal guides 14, 15, e.g. elevated tracks or recesses, which are arranged to interact with the tool in order to align the tool in a correct position vis-á-vis the side pocket 8 when the injection fluid flow control device is retrieved and replaced.

The mandrel body 1 further comprises at least one first opening or passage 16 providing a fluid conduit from an outside of the mandrel body 1 into the side pocket 8, and at least one second opening or passage 17 providing a fluid conduit from the side pocket 8 to the main conduit 6, which first and second passages 16, 17 provide a passageway for an injection fluid from the outside of the mandrel body 1 into the main conduit 6 via an injection fluid flow control device (not depicted) arranged in the side pocket 8, thus allowing the injection fluid flow control device to regulate the flow of injection fluid from the outside of the mandrel body 1 into the main conduit 6 via the passages 16 and 17 which is, as such, known by the skilled person. To this end, an internal surface 18 of the side pocket 8 exhibits structures 19, e.g. annular recesses and elevated sections, for interacting with latches and seals of the injection fluid flow control device such that the flow path of the injection fluid is directed from the first passage 16 to inlet ports of the injection fluid flow control device, and from outlet ports of the injection fluid flow control device to the second passage 17, when the injection fluid flow control device is mounted in the side pocket 8.

A plug 20 is positioned in the side pocket 8 providing a fluid-tight termination of the side pocket 8 at the end of the side pocket 8 which is opposite the opening 10. Consequently, the side pocket 8 extends from the opening 10 to the plug 20.

According to the invention, the mandrel body 1 is produced from a continuous, solid piece of material, or blank, made from a steel alloy suitable for down-hole hydrocarbon well applications.

The method of producing the mandrel body 1 comprises the step of machining the blank externally using any suitable means such that the blank obtains a generally elongated, cylindrical form displaying a laterally offset section which is to house the side pocket section 7. The process of machining may comprise turning, boring, drilling, milling, broaching, sawing, electrical discharge machining (EDM) or any other prior art machining method.

The method of producing the mandrel body 1 further comprises the step of forming the main conduit 6 in the mandrel body. This may be achieved by machining, e.g. drilling, a through-going bore in the blank and machining the inside surface 12 of the through-going bore, e.g. using electrical discharge machining (EDM), such that the desired guides 14 for the injection fluid flow control device replacement tool, and other desired structures, are obtained. Alternatively, if the blank is produced by casting, a through-going opening or channel in the blank may be formed already during the casting process, which through-going opening or channel is subsequently machined internally, e.g. using EDM, to form the main conduit 6.

The method of producing the mandrel body 1 also comprises the step of forming the recess 11 by machining the inside of the main conduit, e.g. using EDM, removing blank material. This step also comprises machining the internal surface 13 of the recess 11 such that the desired guides 15 for the injection fluid flow control device replacement tool, and other desired structures, are obtained.

The method of producing the mandrel body 1 also comprises the step of forming the side pocket 8 by machining, e.g. drilling, a bore 21 into the offset section 7 generally parallel to the main conduit 6, i.e. into the laterally offset section, leaving an internal wall section 9 between the main conduit 6 and the bore 21. Once completed, the bore 21 displays an external entrance opening 23. If the recess 11 is formed prior to the bore 21, the bore 21 is advantageously bored into the recess 11. The step of forming the side pocket 8 also comprises machining the internal surface 18 of the bore 21 such that the desired structures for interacting with latches and seals of the injection fluid flow control device, and other desired structures, are obtained. The step of forming the side pocket 8 further comprises plugging the entrance opening 23 of the bore 21, i.e. at the surface of the mandrel body 1, using the above-disclosed plug 20. This may advantageously be performed by the step of screwing the plug 20 into the bore 21, in which case external threads (not disclosed) are formed on the plug 20 and internal threads 22 (cf. FIG. 3) are formed at the entrance of the bore 21 prior to the plugging operation.

It may be advantageous to produce the plug 20 from the same material as the blank, i.e. from a steel alloy which is suitable for down-hole hydrocarbon well applications.

The method of producing the mandrel body 1 further comprises the step of forming said at least one first opening or passage 16 by machining, e.g. drilling, one or a plurality of bores from the outside of the side pocket section 7 and into the bore 21, and also the step of forming said at least one second opening or passage 17 by machining, e.g. using EDM, one or a plurality of bores through the internal wall section 9.

The method of producing the mandrel body 1 also comprises the step of forming said first and second connection arrangements, allowing the mandrel body 1 to be connected to up-hole and down-hole sections of a production tubing.

The invention claimed is:

1. A method of producing a side pocket mandrel body for use in a hydrocarbon well side pocket mandrel assembly, which side pocket mandrel body comprises:

a first end displaying, at a down-hole end of the first end, a first connection arrangement for connecting the side pocket mandrel body to an up-hole section of a production tubing of the hydrocarbon well, and a second end displaying, at an up-hole end of the second end, a second connection arrangement for connecting the side pocket mandrel body to a down-hole section of the production tubing;

a longitudinal, through-going main conduit for communicating with a central passageway of the production tubing, wherein the main conduit extends from the down-hole end of the first end to the up-hole end of the second end and is substantially the same size as the production tubing; and a side pocket section extending from the main conduit and comprising at least one side pocket, wherein the down-hole end of the first end is located up-hole of the side pocket section, and wherein the method comprises the steps of:

providing a continuous, solid piece of material with the through-going main conduit in the solid piece of material, forming said at least one side pocket by machining a bore, displaying an external entrance opening, into a laterally offset section of the solid piece of material generally parallel to the main conduit such that an internal wall section of the solid piece of material is brought to separate the main conduit from the machined bore;

plugging the entrance opening of the machined bore with a fluid-tight plug; and providing the solid piece of material with the first and the second connection arrangements, thereby rendering the side pocket mandrel body connectable to the up-hole and down-hole sections of the production tubing.

2. The method according to claim 1, wherein the step of forming said at least one side pocket further comprises the step of machining structures for interacting with latches and seals of the injection fluid flow control device in an internal surface of the machined bore.

3. The method according to claim 2, wherein the step of plugging the entrance opening of the machined bore with a fluid-tight plug further comprises the steps of:

providing the plug with external threads;

providing the entrance opening with internal threads; and screwing the plug into the entrance opening.

4. The method according to claim 2, further comprising the steps of:

forming a recess within the side pocket mandrel body by machining the inside of the main conduit removing material internally from said solid piece of material; and bringing the recess to communicate with said at least one side pocket, thereby bringing the at least one side pocket accessible via the recess.

5. The method according to claim 1, wherein the step of forming said at least one side pocket further comprises the step of providing a hollow cylinder into the machined bore prior to the step of plugging the entrance opening, the hollow cylinder comprises structures for interacting with latches and seals of the injection fluid flow control device.

6. The method according to claim 5, wherein the step of plugging the entrance opening of the machined bore with a fluid-tight plug further comprises the steps of:

providing the plug with external threads;

providing the entrance opening with internal threads; and screwing the plug into the entrance opening.

7. The method according to claim 5, further comprising the steps of:

forming a recess within the side pocket mandrel body by machining the inside of the main conduit removing material internally from said solid piece of material; and bringing the recess to communicate with said at least one side pocket, thereby bringing the at least one side pocket accessible via the recess.

8. The method according to claim 1, wherein the step of plugging the entrance opening of the machined bore with a fluid-tight plug further comprises the steps of:

providing the plug with external threads;

providing the entrance opening with internal threads; and screwing the plug into the entrance opening.

9. The method according to claim 8, further comprising the steps of:

forming a recess within the side pocket mandrel body by machining the inside of the main conduit removing material internally from said solid piece of material; and bringing the recess to communicate with said at least one side pocket, thereby bringing the at least one side pocket accessible via the recess.

10. The method according to claim 1, further comprising the steps of forming a recess within the side pocket mandrel body by machining the inside of the main conduit removing material internally from said solid piece of material; and bringing the recess to communicate with said at least one side pocket, thereby bringing the at least one side pocket accessible via the recess.

11. The method according to claim 10, further comprising the step of machining guides for an injection fluid flow control device replacement tool in an internal surface of the recess.

* * * * *